United States Patent [19]

Nagashima et al.

[11] Patent Number: 4,612,838

[45] Date of Patent: Sep. 23, 1986

[54] ELECTRONIC MUSICAL INSTRUMENT

[75] Inventors: Yoichi Nagashima, Hamamatsu; Tatsunori Kondo, Shizuoka; Kiyomi Takauji, Hamamatsu; Mineo Kitamura, Hamamatsu; Tadashi Matsushima, Hamamatsu; Eiji Nagashima, Kami; Masafumi Mizoguchi, Hamamatsu, all of Japan

[73] Assignee: Kabushiki Kaisha Kawai Gakki Seisakusho, Japan

[21] Appl. No.: 665,124

[22] Filed: Oct. 26, 1984

[30] Foreign Application Priority Data

Oct. 27, 1983 [JP] Japan ..... 58-201665

[51] Int. Cl.[4] ..... G10H 1/08; G10H 7/00

[52] U.S. Cl. ..... 84/1.01; 84/1.22

[58] Field of Search ..... 84/1.01, 1.19–1.23

[56] References Cited

U.S. PATENT DOCUMENTS

| | | | |
|---|---|---|---|
| 4,189,970 | 2/1980 | Woron | 84/1.19 |
| 4,205,575 | 6/1980 | Hoskinson et al. | 84/1.01 |
| 4,246,823 | 1/1981 | Wachi et al. | 84/1.22 |
| 4,344,343 | 8/1982 | Deforeit | 84/1.01 |
| 4,348,929 | 9/1982 | Gallitzendörfer | 84/1.01 |
| 4,352,312 | 10/1982 | Whitefield et al. | 84/1.22 X |
| 4,444,082 | 4/1984 | Whitefield | 84/1.22 X |
| 4,536,853 | 8/1985 | Kawamoto et al. | 84/1.01 X |

*Primary Examiner*—S. J. Witkowski

*Attorney, Agent, or Firm*—McGlew and Tuttle

[57] ABSTRACT

In an electronic musical instrument which generates a musical waveform by calculating the waveform amplitude value at each sample point through Fourier synthesis, there is provided a musical waveform generator for caculating and synthesizing a temporally varying musical waveform at a plurality of sample points, memory circuits for storing two kinds of musical waveforms obtained by the musical waveform generator one after the other and an interpolation circuit for interpolating the two musical waveforms at time intervals shorter than the time intervals used in the musical waveform generator.

3 Claims, 21 Drawing Figures

ELECTRONIC MUSICAL INSTRUMENT

BACKGROUND OF THE INVENTION

1. Field of the Invention

The present invention relates to an electronic musical instrument of the type that generates a musical waveform by computing its amplitude value at each sample point through Fourier synthesis, and more particularly to an electronic musical instrument which is adapted so that two kinds of musical waveforms calculated and synthesized one after the other are interpolated at shorter time intervals, thereby effectively obtaining temporal variations of the musical waveforms with a small volume of waveform synthesis calculation.

2. Description of the Prior Art

Heretofore, there have been proposed many digital type electronic musical instruments which produce the amplitude value of a musical waveform at each sample point thereof by some methods and read it out at a readout rate corresponding to the note frequency of a musical sound to be produced. The simplest one of them is what is called a "waveform-memory method" which stores and reads out waveform data itself, and a method that converts an analog input to digital form to obtain waveform data is also one of the simplest methods. However, these conventional methods are defective in that an enormous memory capacity is needed for varying the musical waveform with the note range of a musical sound to be produced and in that the musical aveform undergoes no temporal variations. Furthermore, there have also been proposed a method of computing parameters through the use of various continous functions and a method of computing temporal variations of the musical waveform in a real-time waveform synthesis by a frequency modulation method, but the correspondence between a parameter for the waveform generation and the timbre of the musical sound actually produced is unnatural to the human sense, and a desired timbre is difficult to obtain.

On the other hand, a musical waveform generating system utilizing Fourier synthesis has undergone various improvements for making up for the defect of a large volume of waveform synthesis calculation and has been widely employed since parameters for harmonic coefficients naturally correspond to an auditory evaluation of timbre. In the musical waveform generation system utilizing Fourier synthesis, it is the component ratio of a harmonic coefficient that determines the timbre of a musical sound. As a method for causing temporal variations in the musical waveform, there has been suggested a method of selecting many harmonic coefficients by using a plurality of memories, but this method has such a shortcoming that sufficient timbre variations cannot be obtained in spite of an enormous circuit scale. Furthermore, there have been proposed a system which multiplies a preset harmonic coefficient and a parameter of a Formant filter, as described in Japanese Patent Publication No. 46445/78, and a system which multiplies a temporal variation function for each harmonic coefficient, as described in Japanese Patent Public Disclosure No. 172396/84. With these conventional systems, however, a harmonic coefficient multiplying circuit is required, and in addition, since the calculation of the musical waveform involves a multiplication and an accumulation, calculations of temporal variations of each harmonic coefficient of higher order are limited in terms of the scale of circuit, the volume of calculation and the calculating speed, the temporal variations calculated are not satisfactory as temporal variations in the digital type electronic musical instrument.

SUMMARY OF THE INVENTION

It is therefore an object of the present invention to provide an electronic musical instrument which is free form the abovesaid defects of the prior art and is capable of producing temporal variations of a musical waveform with a small volume of waveform synthesis calculation.

Briefly stated, the electronic musical instrument of the present invention is provided with a musical waveform generator for calculating and synthesizing a temporally varying musical waveform at a plurality of sample points, a memory circuit for storing two kinds of musical waveforms obtained by the musical waveform generator one after the other and an interpolation circuit for interpolating the two musical waveforms at time intervals shorter than the time intervals used in the musical waveform generator.

BRIEF DESCRIPTION OF THE DRAWINGS

FIG. 4(*b*) is a graph showing the operation of interpolation circuit 15 of FIG. 2;

FIG. 5(*b*) is a graph showing a waveform signal which is generated by calculator 11 of FIG. 2;

FIG. 6(*b*) is a graph similar to FIG. 5(*b*) showing the waveform signal of calculator 11 in FIG. 2 generated from the harmonic coefficient of FIG. 6(*a*);

FIG. 7(*b*) is a graph similar to FIG. 5(*b*) showing the interpolated value one-half of the way to the graph of FIG. 6(*b*);

FIG. 7(*c*) is the interpolated value three-quarters of the way to the curve of FIG. 6(*b*);

FIG. 8(*b*) is a musical waveform of a data stored in the second memory circuit 24 of the embodiment of FIG. 3;

FIG. 8(*c*) is a musical waveform data in the calculator 21 of the embodiment of FIG. 3;

FIG. 8(*d*) is a musical waveform data in an interpolation cirucit 25 of the embodiment of FIG. 3;

FIG. 10(*b*) is a graph showing interpolation points for a non-linear interpolation;

FIG. 11(*b*) is a graph showing interpolation points where amplitude and time vary non-linearly so that the interpolation points lie in a straight line.

DESCRIPTION OF THE PREFERRED EMBODIMENTS

Figure 1:
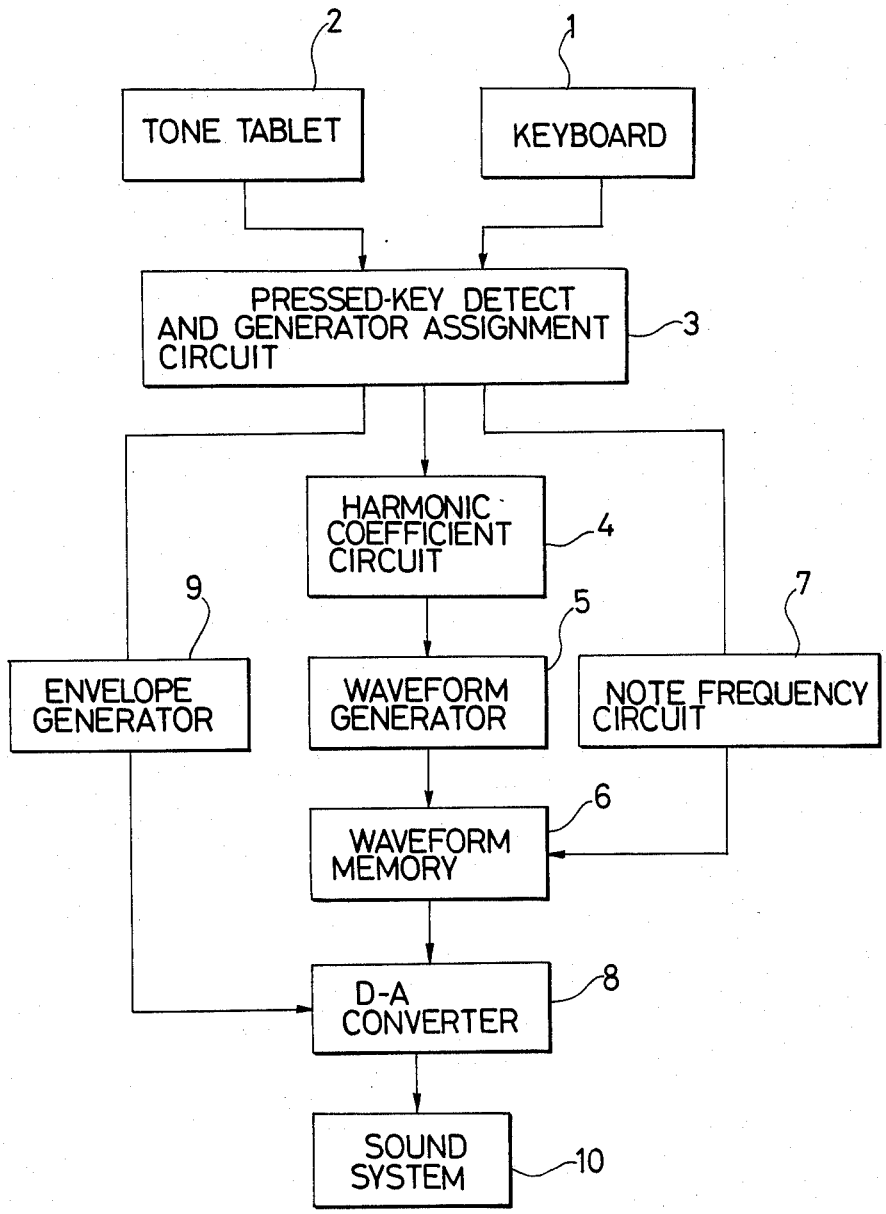
FIG. 1 is a block diagram explanatory of the arrangement of the electronic musical instrument of the present invention.

FIG. 1 illustrates in block form the arrangement of the electronic musical instrument of the present invention. Reference numeral 1 indicates a keyboard; 2 designates a tone tablet; 3 identifies a pressed-key detect and generator assignment circuit; 4 denotes a harmonic coefficient circuit; 5 represents a waveform generator; 6 shows a waveform memory; 7 refers to a note frequency circuit; 8 signifies a D-A converter; and 9 indicates an envelope generator; and 10 designates a sound system.

The pressed-key detect and generator assignment circuit 3 supplies each of the harmonic coefficient circuit 4, the note frequency circuit 7 and the envelope generator 9 with a control signal corresponding to timbre data and performance data input from the keyboard 1 and the tone tablet 2. The harmonic coefficient circuit 4 responds to the timbre data from the pressed-key detect and generator assignment circuit 3 to set Fourier harmonic coefficients for waveform synthesis calculations. The waveform generator 5 sequentially calculates and synthesizes musical waveforms on the basis of the Fourier harmonic coefficients from the harmonic coefficient circuit 4 and provides them to the waveform memory 6. The note frequency circuit 7 responds to the performance data from the pressed-key detect and generator assignment circuit 3 to generate a readout signal corresponding to a musical frequency, by which signal the musical waveform corresponding to the musical frequency is read out of the waveform memory 6. The envelope generator 9 responds to the performance data from the pressed-key detect and generator assignment circuit 3 to set amplitude modulation data such as the attack and decay of each musical sound and its envelope characteristic. By performing the above operations digitally on a time-shared basis, the circuit arrangement can be simplified. The D-A converter 8 converts the musical waveform corresponding to the musical frequency, read out by the note frequency circuit 7 from the waveform memory 8, into analog form and multiplies it by the amplitude modulation data from the envelope generator 9, obtaining an analog signal output. The analog signal output from the D-A converter 8 is converted, by the sound system 10 including an effect circuit, an amplifier and a speaker, into a musical sound of the electronic musical instrument.

Figure 2:
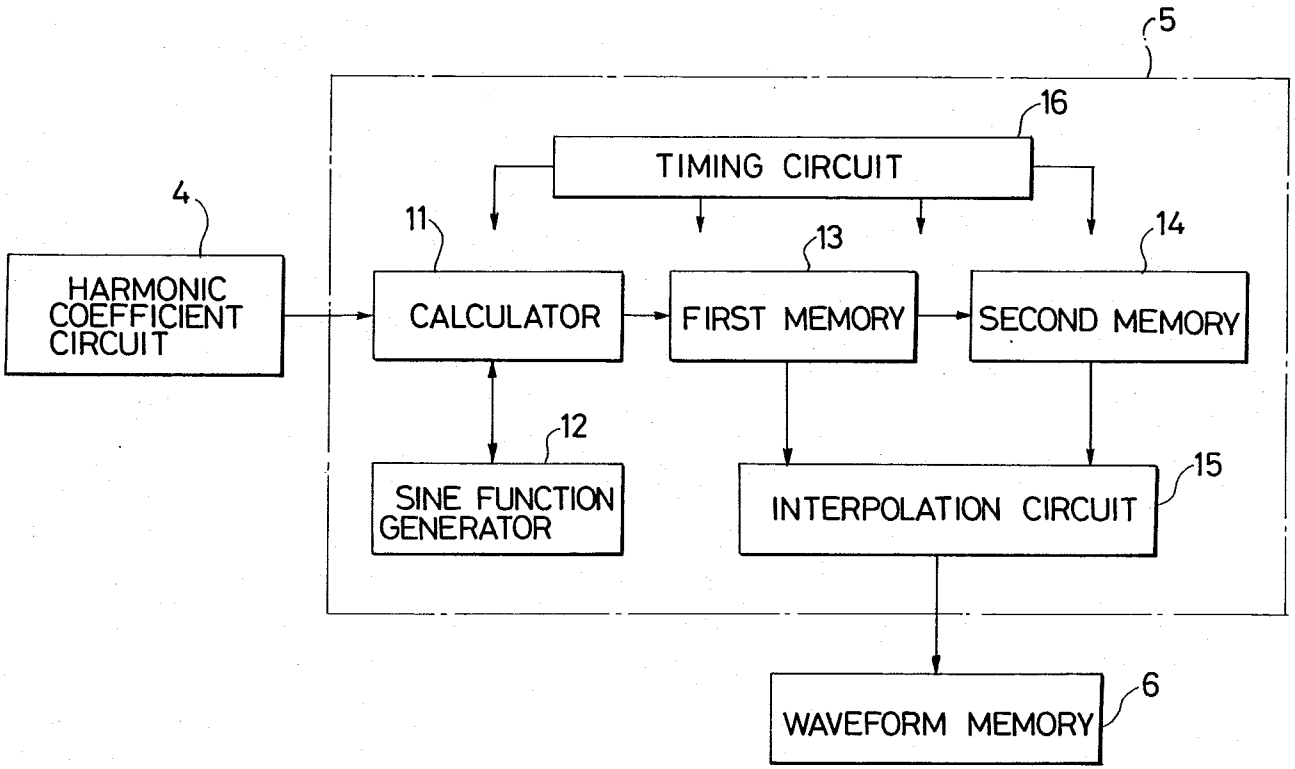
FIG. 2 is a block diagram illustrating a specific operative example of the arrangement of a waveform generator used in FIG. 1.

FIG. 2 illustrates a specific operative example of a musical waveform synthesizing calculation block according to the present invention which is provided in the waveform generator 5 used in FIG. 1. In FIG. 2, reference numeral 11 indicates a calculator for performing a Fourier synthesis calculation; 12 designates a sine function generator for generating trigonometric function data for the Fourier synthesis calculation; 13 identifies a first memory circuit for temporarily storing musical waveform data obtained by the calculator 11; 14 denotes a second memory circuit for temporarily storing the musical waveform data read out of the first memory circuit 13; 15 represents an interpolation circuit for obtaining from the musical waveform data of the first and second memory circuits 13 and 14 musical waveform data which is ultimately provided to the waveform memory 6; and 16 shows a timing circuit for controlling the time-sharing timing in the waveform generator 5 and the operation timing relative to the entire circuit.

A description will be given, with reference to FIG. 2, of the operation of computing and synthesizing a musical waveform by the waveform generator 5. In general, amplitude values of the musical waveform are sequentially computed by the waveform generator 5 in accordance with the following expression:

$$F(s) = \sum_{n=1}^{N} Cn \cdot \sin(2\pi ns/S) \tag{1}$$

where n is the degree of harmonics, N is the highest degree of the harmonics, s is a sample point, S is the number of samples in one cycle and Cn is a harmonic coefficient set by the harmonic coefficient circuit 4. The expression (1) is sufficient for synthesizing a timbre of a constant musical waveform, but in the case of synthesizing a temporally varying musical waveform, it is necessary to perform the following calculation using a temporal parameter t, in addition to the sampling constant s:

$$F(s, t) = \sum_{n=1}^{N} Cn(t) \cdot \sin(2\pi ns/S) \tag{2}$$

Since this calculation is needed for each change in the essentially asynchronous calculation parameters s and t, it is necessary to reduce the number of harmonics or sample points for one cycle according to the scale of the circuit used and its operating speed.

Figure 4A:
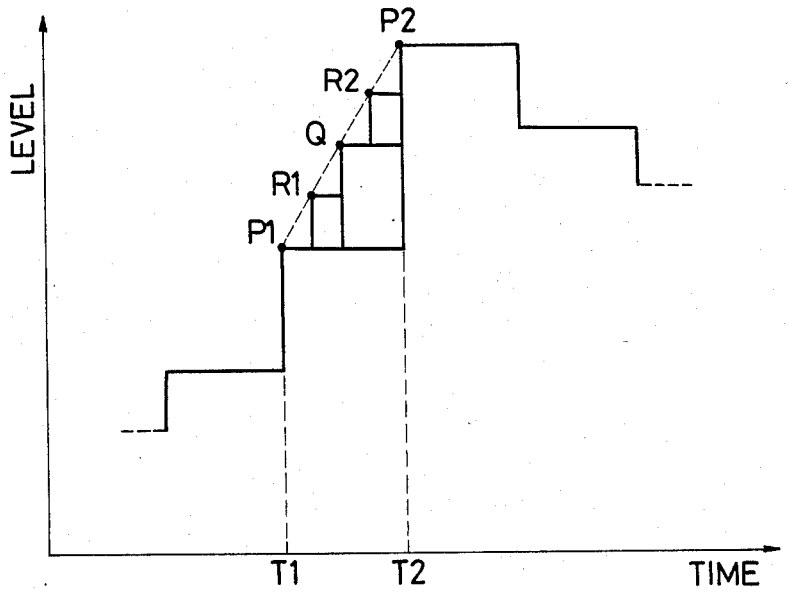
FIG. 4(*a*) is a graph showing a conventional waveform interpolation method.
Figure 4B:
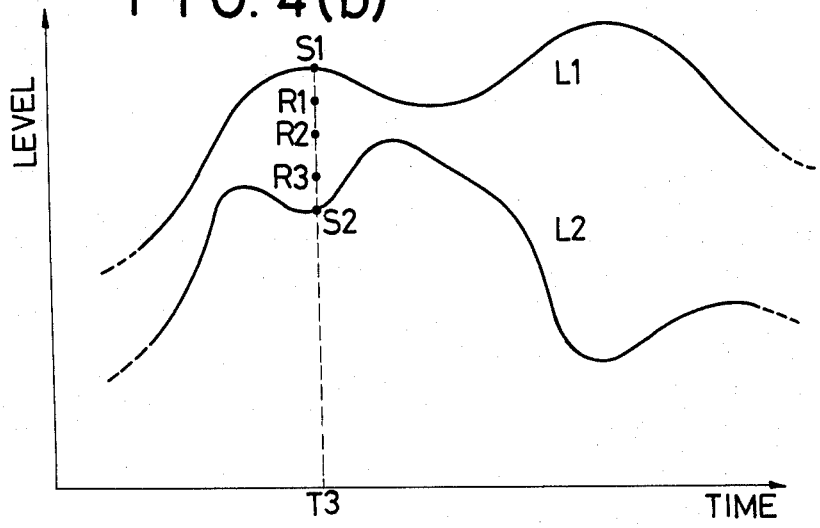

With such an arrangement as shown in FIG. 2, the above musical waveform synthesizing calculation is performed only at a plurality of representative points of time, and a plurality of waveform interpolation values which correspond to points on a time axis which are of shorter intervals than the above plurality of points of time are obtained by the interpolation circuit 15, thereby effectively achieving the temporal variations of the musical waveform with a small volume of waveform synthesis calculation. This operation will be described with reference to waveform diagrams shown in FIGS. 4(*a*) and 4(*b*). FIG. 4(*a*) shows a conventional waveform interpolation method, according to which values Q, R1, R2, . . . are obtained by linearly interpolating sample values P1 and P2 at points of time T1 and T2. This waveform interpolation method is effective for compensating for rough sampling of waveform data, but since a very high-speed interpolating calculation is required for following temporal variations of the musical waveform on a real-time basis, a low-order interpolation is widely employed as a system for sampling noise reduction. FIG. 4(*b*) shows the operation of the interpolation circuit 15 in the present invention. For musical waveforms L1 and L2 at two points of time representative of their temporal variations, sample values S1 and S2 are obtained which correspond to the same sample point of time T3, and values R1, R2, R3 are obtained as interpolation values of these sample values S1 and S2. The difference between the waveform interpolation methods of FIGS. 4(*a*) and 4(*b*) is that the former performs, as an interpolation on the time axis, an interpolation between two points of one waveform at a high speed corresponding to the sampling speed, whereas the latter is an interpolation of sample values of two waveforms. With the interpolation method by the present invention, the musical waveforms L1 and L2 at two points of time representative of their temporal variations can be set at a speed several hundred times lower than the sampling speed, and this vary effective for achieving the temporal variations of a musical waveform with high accuracy.

Figure 5A:
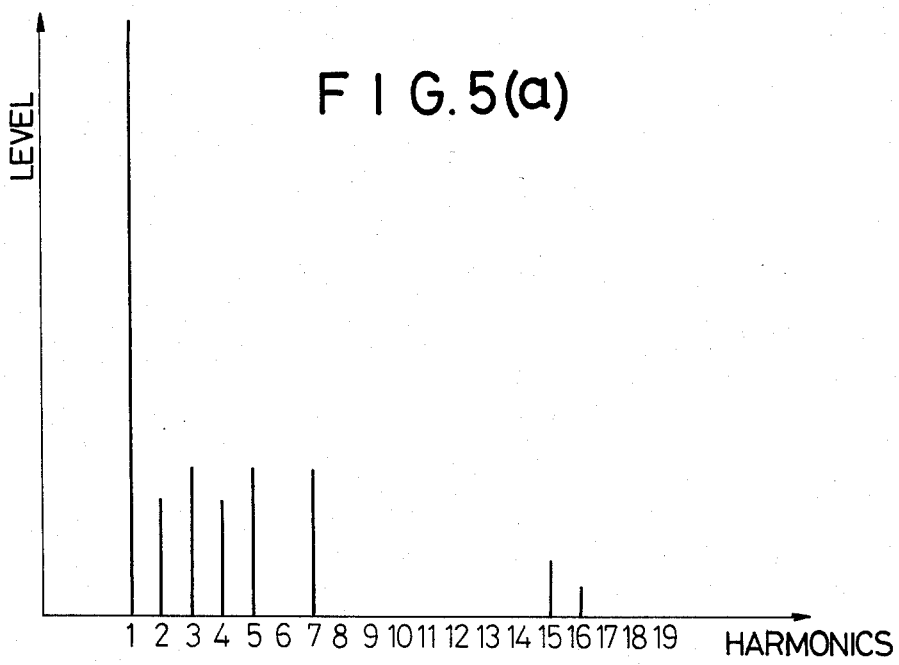
FIG. 5(*a*) is a graph showing a harmonic coefficient for a Fourier waveform synthesis calculation.
Figure 5B:
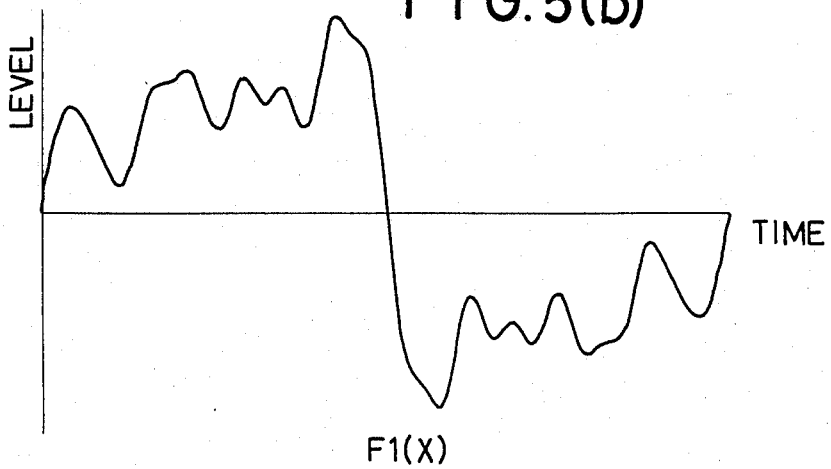
Figure 6A:
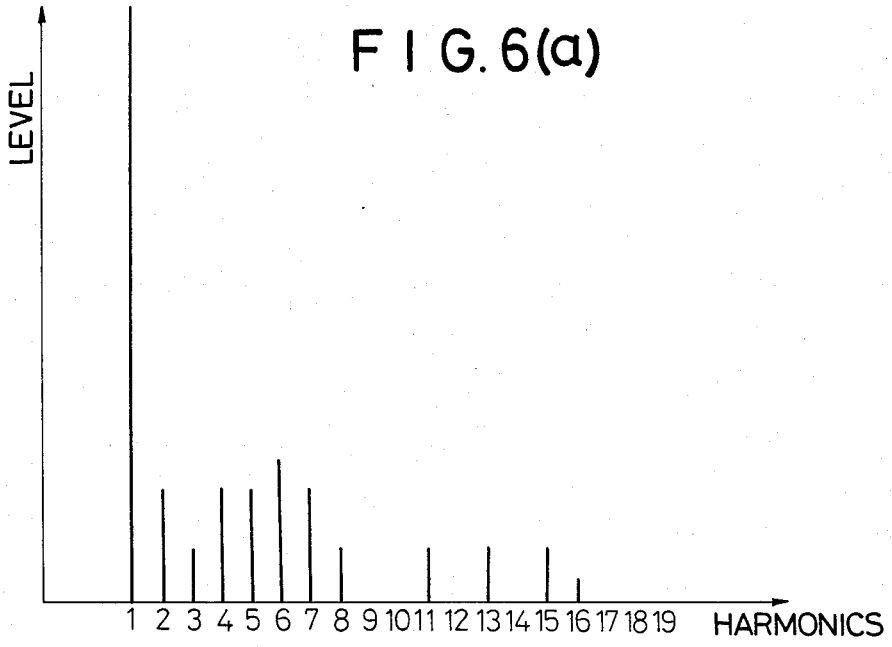
FIG. 6(*a*) is a graph similar to FIG. 5(*a*) showing another harmonic coefficient.
Figure 6B:
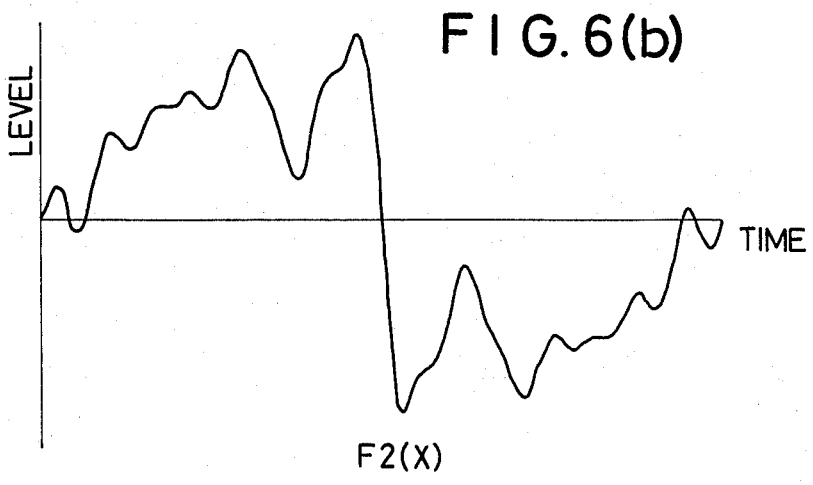
Figure 7A:
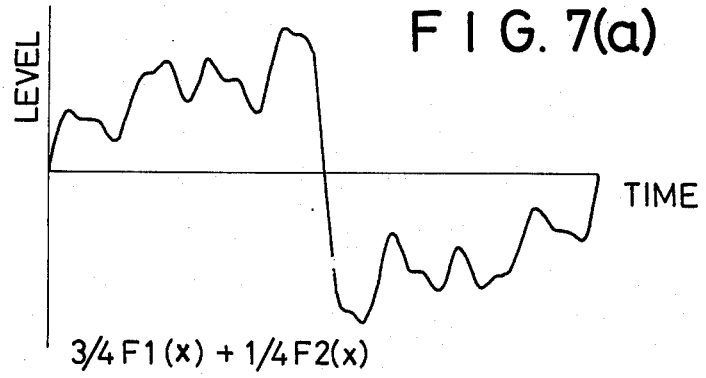
FIG. 7(*a*) is a graph similar to FIG. 5(*b*) showing an interpolated value one-quarter of the distance to the waveform of FIG. 6(*b*)
Figure 7B:
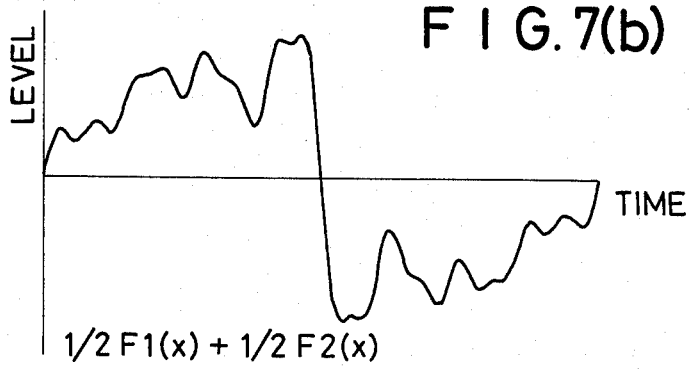
Figure 7C:
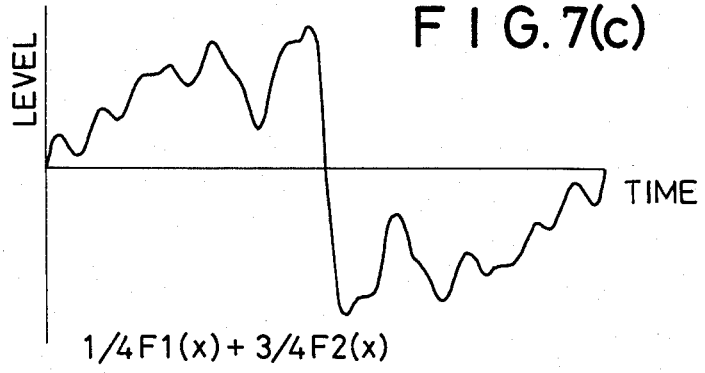

In FIG. 2, the calculator 11 performs a Fourier waveform synthesis calculation at a time t according to the expression (2). When supplied with a harmonic coefficient such, for example, as shown in FIG. 5(*a*), from the harmonic coefficient circuit 4, the calculator 11 produces such a waveform signal F1(x) as shown in FIG. 5(*b*) on the basis of trigonometric function data from the sine function generator 12, which is provided to the first memory circuit 13. In response to the next temporal variation of the musical waveform, the waveform signal F1(x) in the first memory circuit 13 is provided to the second memory circuit 14 under the control of the timing circuit 16, and at the same time, such a harmonic coefficient as shown in FIG. 6(*a*), for instance, is applied from the harmonic coefficient circuit 4 to the calculator 11, from which such a waveform F2(x) as shown in FIG. 6(*b*) is provided to the first memory circuit 13. The interpolation circuit 15 performs the "interpolation of a sample value of a waveform" at the same sample point for the waveform signal F2(x) stored in the first memory circuit 13 and the waveform signal F1(x) stored in the second memory circuit 14. FIGS. 7(*a*) to 7(*c*) show interpolation values divided into quarters in the above example. The interpolation value varies by steps of 25% in an order FIG. 5(*b*) - FIG. 7(*a*)- FIG. 7(*b*) - FIG. 7(*c*) - FIG. 6(*b*), from which it will be seen that the waveform varies smoothly. From the viewpoint of computing speed, it is necessary only that the interpolating operation be carried out in a relatively long time interval after each Fourier waveform synthesis calculation according to the expression (2) at the time t. In view of the human perceptibility and discriminating power, a computing time of 2 to 3 mesc will be sufficient for the interpolating operation. On the other hand, in the case of supplying the harmonic coefficient Cn(t) from the harmonic coefficient circuit 4 while varying it in the expression (2) on a real-time basis, even if the number of sample points is limited, the computing time for the waveform generator 5 is only several microseconds. This difference in speed is significant in the actual formation of the circuit.

Figure 3:
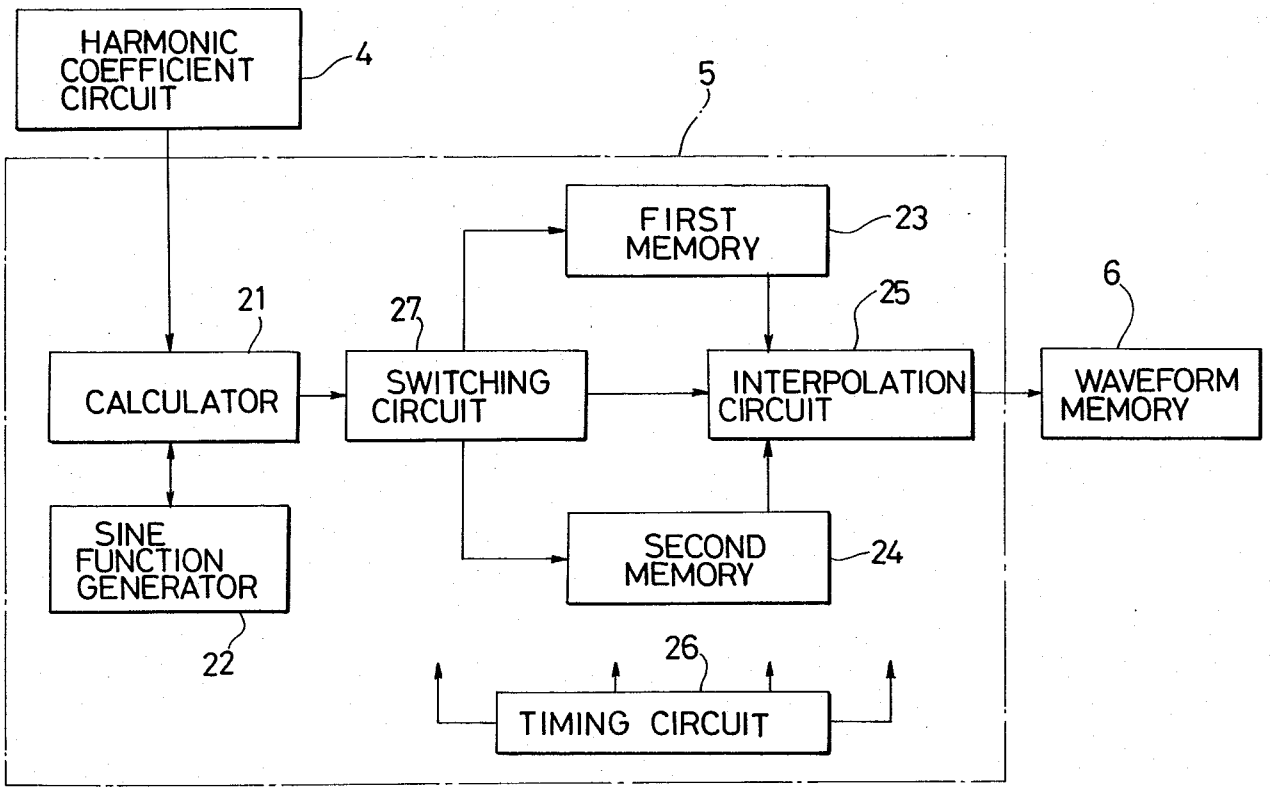
FIG. 3 is a block diagram illustrating another specific operative example of the arrangement of the waveform generator 5.

FIG. 3 illustrates another example of the musical waveform synthesizing calculation block which is provided in the waveform generator 5 shown in FIG. 1. In FIG. 3, reference numeral 21 indicates a calculator for performing the Fourier synthesis calculation; 22 designates a sine function generator for generating trigonometric function data for the Fourier synthesis calculation; 23 identifies a first memory circuit for temporally storing musical waveform data obtained by the calculator 21; 24 denotes a second memory circuit for temporally storing the musical waveform data obtained by the calculator 21; 25 represents an interpolation circuit for obtaining from the musical waveform data of the first and second memory circuits 23 and 24 musical waveform data which is ultimately provided to the waveform memory 6; 27 shows a switching circuit for selectively switching the first and second memory circuits 23 and 24; and 26 refers to a timing circuit for controlling the time-sharing timing in the waveform generator 5 and the timing relative to the entire circuit operation.

Figures 8A, 8B, 8C, 8D:
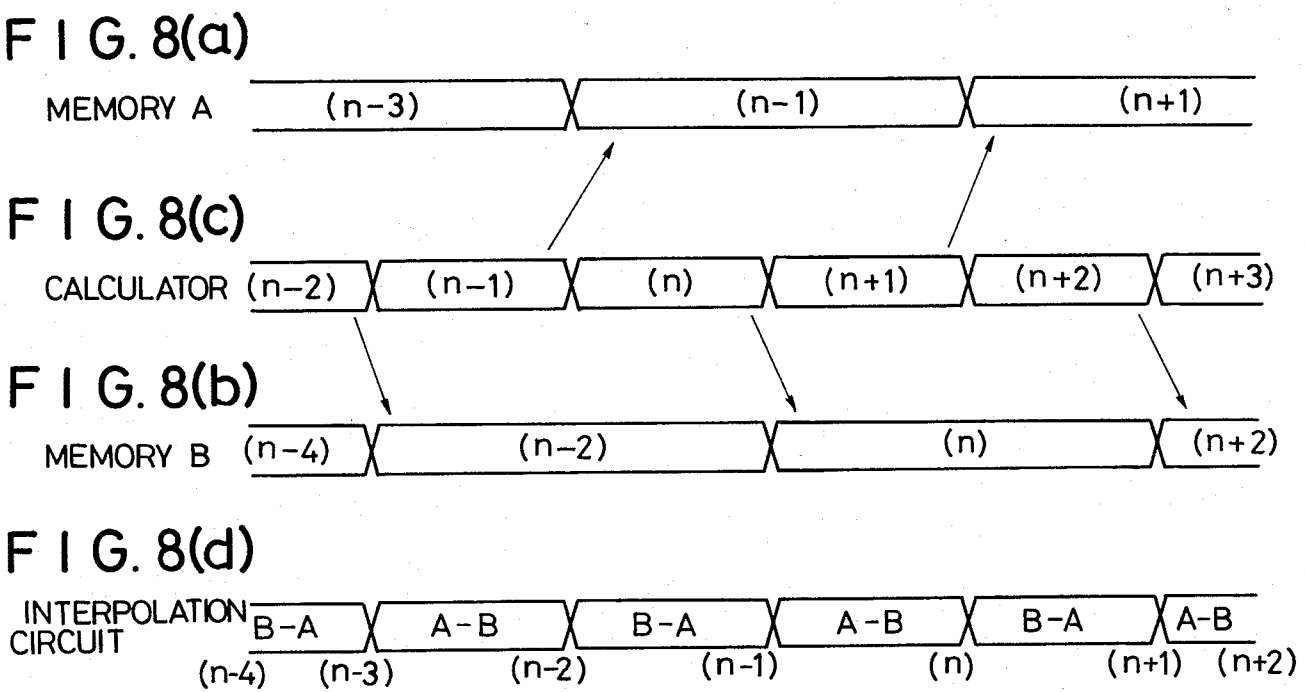
FIG. 8(*a*) is a musical waveform of a data stored in a first memory circuit 23 of the embodiment of FIG. 3.

A description will be given, with reference to FIGS. 8(*a*) to 8(*d*), of the operation of the example shown in FIG. 3. FIG. 8(*a*) shows musical waveform data A stored in the first memory circuit 23, FIG. 8(*b*) musical waveform data B stored in the second memory circuit 24, FIG. 8(*c*) musical waveform data in the calculator 21 and FIG. 8(*d*) musical waveform data in the interpolation circuit 25. (n−1), (n), (n+1), . . . indicate the sequence of calculations by the calculator 21 and they correspond to a plurality of representative points of time for the musical waveform synthesis calculation. In FIGS. 8(*a*) to 8(*d*), musical waveform data obtained by the synthesis calculation in the calculator 21 at (n−2) is provided via the switching circuit 27 to the second memory circuit 24 for storage therein as the musical waveform B, and musical waveform data obtained next by the calculator 21 at (n−1) is provided via the switching cirucit 27 to the first memory circuit 23 for storage therein as the musical waveform A. During the synthesis calculation by the calculator 21 at (n), the interpolation circuit 25 performs an interpolating calculation from the musical waveform data B to the musical waveform data A and ultimately provides the interpolated musical waveform data to the waveform memory 6. It is determined, in synchronism with the operation of selecting the first memory circuit 23 or second memory circuit 24 by the switching circuit 27, which one of the musical waveform data A and B is used as an initial or target value. In this while, musical waveform data obtained by the calculator 21 at (n) is applied via the switching circuit 27 to the second memory circuit 24 for storage as the musical waveform data B, and thereafter the same operation will be repeated.

Operational features of and difference between the examples shown in FIGS. 2 and 3 are most marked in the operations of the first and second memory circuits. That is, in the first and second memory circuits 13 and 14 the musical waveform data is always subjected to the same transfer operation so that the musical waveform data in the first memory circuit 13 is used as the initial value and the musical waveform data in the second memory circuit 14 as the target value. This can be achieved with a simple circuit arrangement, but it is necessary to transfer the musical waveform data in each memory at a relatively high speed in accordance with the operating times of the calculator 11 and the interpolation circuit 15; especially, a time slot must be provided for the transfer from the first memory circuit 13 to the second one 14. In contrast thereto, the first and second memory circuits 23 and 24 in FIG. 3 have exactly the same function, and it is determined, by selecting the first memory circuit 23 or the second memory circuit 24 by the switching circuit 27, which one of the two musical waveform data A and B is used as the initial or target value. Therefore, it is necessary that the interpolation circuit 25 change over the object of calculation at each point of time for the musical waveform synthesis calculation on the basis of a control signal from the switching circuit 27 which indicates which one of the musical waveform data A and B is used as the initial value and which one of them is used as the target value. As is evident from FIGS. 8(*a*) to 8(*d*), however, the embodiment of FIG. 3 is advantageous in that there is a margin in the operating time of each memory circuit and that the time slot for the transfer from the first memory circuit to the second one need not be provided.

Figure 9:
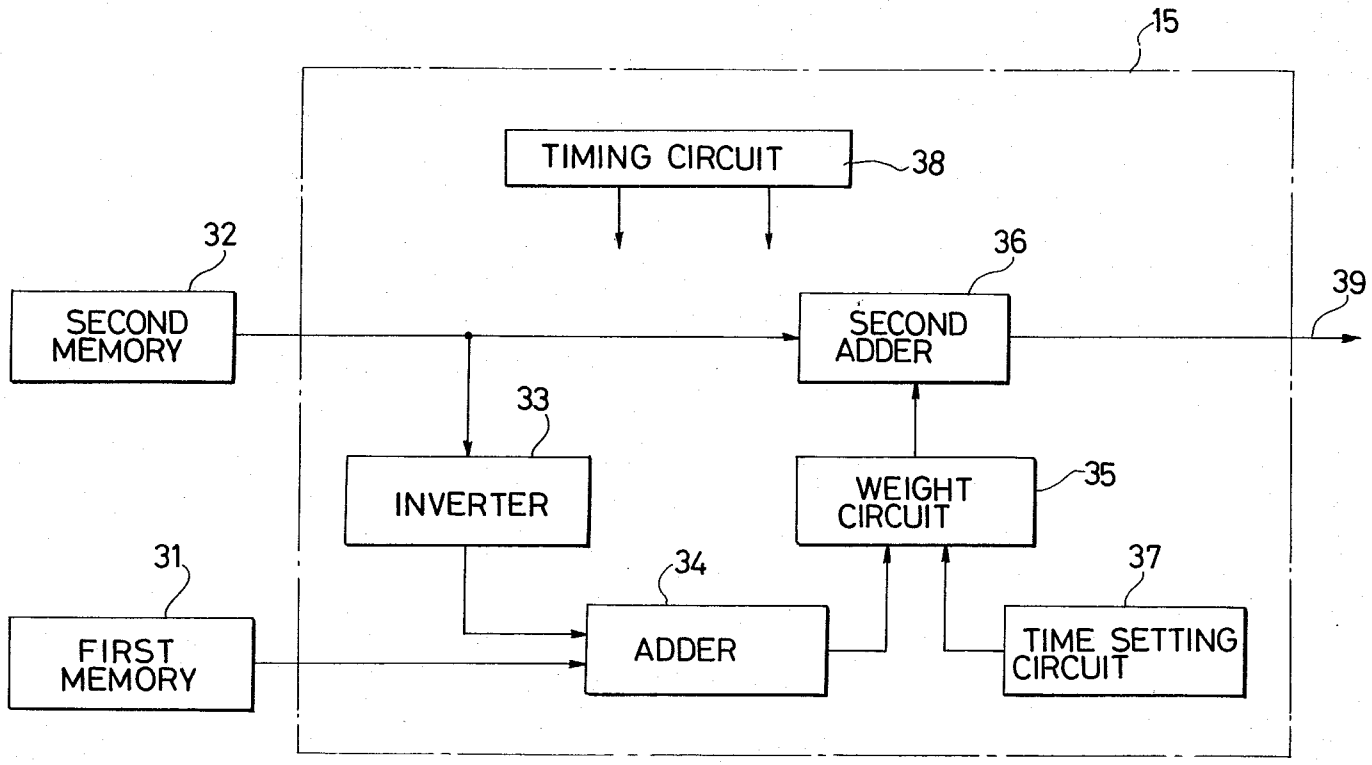
FIG. 9 is a block diagram 11 illustrating a specific operating example of the arrangement of an interpolation cirucit 15 used in FIG. 2.

FIG. 9 illustrates a specific example of the arrangement of an interpolation block which is provided in the interpolation circuit 15 in FIG. 2. In FIG. 9, reference numeral 31 indicates a first memory circuit for supplying the musical waveform data A; 32 designates a second memory circuit for supplying the musical waveform data B; 33 identifies an inverter for inverting the musical waveform data A; 34 denotes a first adder for adding the musical waveform data A and B; 35 represents a weight circuit for setting an interpolation system; 36 shows a second adder; 37 refers to a time setting circuit for setting a time-axis parameter for interpolation; and 38 signifies a timing circuit for controlling synchronous circuit operations and time-shared operations of the entire system.

Figure 10A:
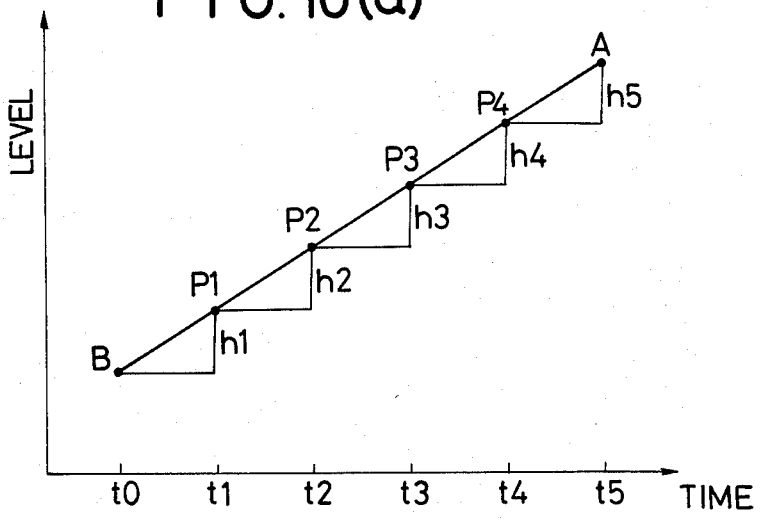
FIG. 10(*a*) is a graph showing an interpolation wherein a weight function is set by a time setting circuit 37 of the embodiment of FIG. 9.
Figure 10B:
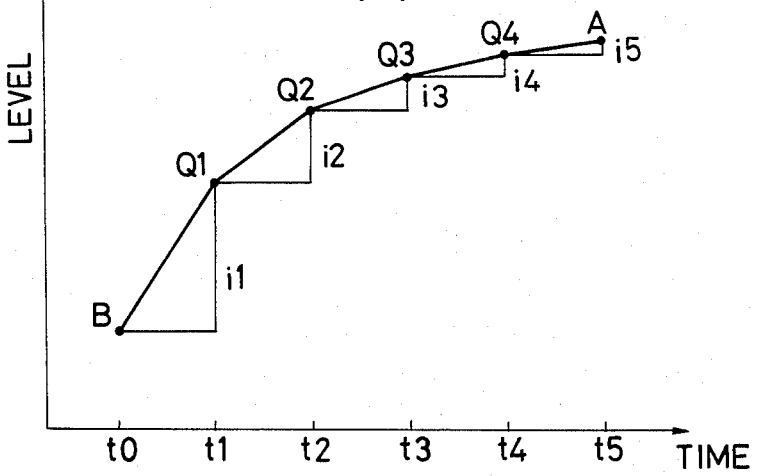

A description will be given, with reference to FIGS. 10(*a*), 10(*b*), 11(*a*) and 11(*b*), of the operation of the example of the interpolation block shown in FIG. 9. In this example, the interpolation circuit 15 is supplied with the musical waveform data A as the target value and the musical waveform data B as the initial value. Letting the musical waveform data A and B at a point of time T for the musical waveform synthesis calculation be represented by A(T) and B(T), respectively, waveform data −B(T) inverted by the inverter 33 from the waveform data B(T) and the musical waveform data A are added in the first adder 34, obtaining the following difference value data:

$$A(T)-B(T) \tag{3}$$

The difference value data is provided to the weight circuit 35. On the other hand, in the time setting circuit 37, a weight function M(t) necessary for the weight circuit 35 is set using a time parameter t on which the interpolating calculation is based, and the weight circuit 35 produces the following weighted difference value data:

$$M(t)\cdot(A(T)-(B)) \tag{4}$$

This weighted difference value data is provided to the second adder 36, wherein it is added to the musical waveform data B(T) from the second memory circuit 32 to obtain the following data:

$$B(T)+M(t)\cdot(A(T)-B(T)) \tag{5}$$

This data is ultimately applied as output musical waveform data 39 to the waveform memory 6. Modifying the expression (5), it follows that $$M(t)\cdot A(T)+(1-M(t))\cdot B(T) \tag{6}$$

This is no other than a weighted mean of A(T) and B(T) which uses M(t) as a coefficient. By selecting the weight function M(T) in the following range:

$$0 \leqq M(t) \leqq 1 \tag{7}$$

the output musical waveform data 39 can be used as an arbitrary interpolation value from the musical waveform data A(T) to the musical waveform data B(T). FIG. 10(*a*) shows the interpolation in the case where the weight function M(t) set by the time setting circuit 37 is so set as to have the same incremental value with respect to the time parameter of equal intervals. In FIG. 10(*a*), interpolation points P1, P2, . . . obtained with the same incremental value h1=h2=. . . relative to time parameters of equal intervals t1, t2, . . . lie on a straight line, by which the musical waveform data of the initial and the target value are linearly interpolated. FIG. 10(*b*) shows interpolation points Q1, Q2, . . . in the case where relative to the time parameters t1, t2, . . . of equal intervals, an incremental value i is set by the following recurrence formula:

$$i(n+1)\ i(n)/2,$$

$$i(1)=(A(T)-B(T)/2 \tag{8}$$

Figure 11A:
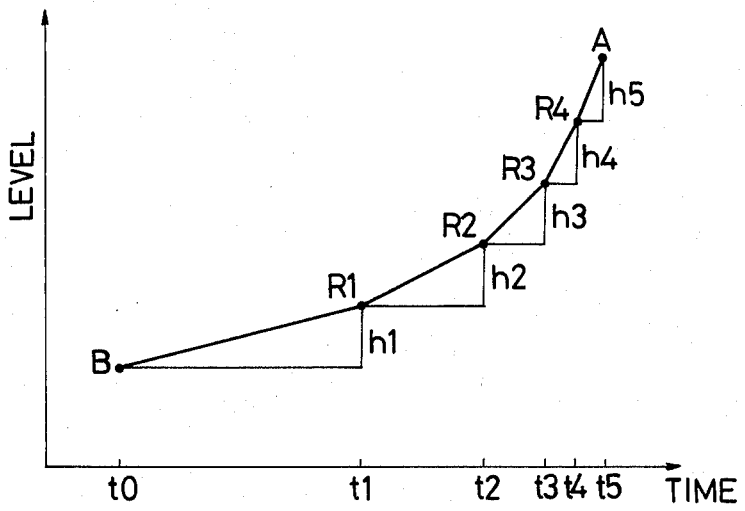
FIG. 11(*a*) is a graph showing interpolation points obtained using a non-linear time parameter.
Figure 11B:
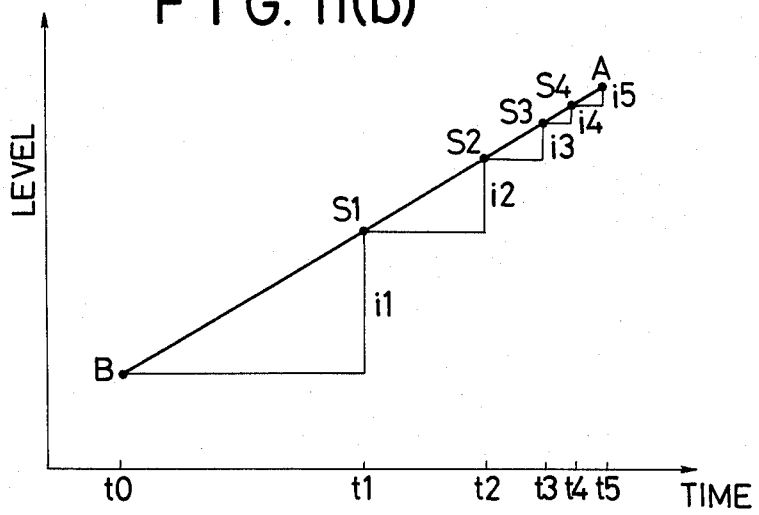

The musical waveform data of the initial value and the musical waveform data of the target value are interpolated nonlinearly, but since the expression (8) can easily be achieved by a binary shift circuit, this method is an effective interpolation method according to the number of points interpolation. FIG. 11(*a*) shows interpolation points R1, R2, . . . obtained in the case of setting the time parameter t by the following recurrence formula:

$$t(n+1)-t(n)=(t(n)-t(n-1)/2 \tag{9}$$

and using the same incremental value h1=h2=. . . In this case, the musical waveform data of the initial value and the musical waveform data of the target value are interpolated nonlinearly, but since the expression (9) can easily be achieved by a binary shift circuit, this method is also effective according to the setting condition of the time parameter t for interpolation. FIG. 11(*b*) shows interpolation points S1, S2, . . . in the case where the time parameter is set by the expression (9) and the incremental value i is set by the expression (8). In this case, the interpolation points S1, S2, . . . lie on a straight line, and the musical waveform data of the initial value and the musical waveform data of the target value are interpolated linearly. This method can also be achieved by the use of a binary shift circuit and is effective according to the number of interpolation points.

As has been described in the foregoing, the present invention provides, for the electronic musical instruments of the type forming a musical waveform by the Fourier synthesis calculation, a novel musical waveform generating system which does not require a high-speed circuit arrangement for calculating temporal variations of the musical waveform but is adapted so that two kinds of musical waveforms calculated and synthesized one after the other at a low speed are interpolated at shorter time intervals, thereby effectively producing temporal variations of the musical waveform. Accordingly, the present invention offers an electronic musical instrument of high musicality, and hence greatly contributes to the creation of good music.

It will be apparent that many modifications and variations may be effected without departing from the scope of the novel concepts of the present invention.

What is claimed is:

1. An electronic musical instrument of the type that forms a musical waveform by calculating the waveform amplitude value at each sample point thereof through Fourier synthesis, comprising:

a musical waveform generator for calculating and synthesizing a temporally varying musical waveform at a plurality of representative points of time;

a memory circuit for temporally storing only two musical waveform data which are calculated and synthesized by the musical waveform generator one after the ohter at successive points of time; and an interpolation circuit for reading out the two musical waveform data from the memory circuit and calculating a plurality of waveform interpolation values corresponding to points on a time axis which are of shorter time intervals than the time intervals of the plurality of representative points of time;

wherein the musical waveform is effectively varied temporally with a small amount of waveform synthesis calculation per unit time.

2. An electronic musical instrument according to claim 1, which the interpolation circuit includes a weight setting circuit for setting a weight function for the two musical waveform data, a temporal variation circuit for temporally varying the weight function and an interpolation calculating circuit for calculating an interpolation value on the basis of the two musical waveform data and the weight function, and wherein the state of temporal variation of the waveform interpolating calculation can be controlled arbitrarily.

3. An electronic musical instrument according to claim 1, wherein the interpolation circuit includes a difference value setting circuit for obtaining a difference value between the two musical waveform data, an incremental value setting circuit for obtaining incremental value data by binary-shifting the difference value and an interpolation calculating circuit for calculating an interpolation value on the basis of the two musical waveform data and the incremental value data, and wherein the state of temporal variation of the waveform interpolating calculation can be controlled exponentially.

* * * * *